US006698047B1

(12) United States Patent
Ogle

(10) Patent No.: US 6,698,047 B1
(45) Date of Patent: Mar. 2, 2004

(54) HINGED MATTRESS AND COVER COMBINATION

(76) Inventor: David D. Ogle, 13191 Contessa, Tustin, CA (US) 92782

( * ) Notice: Subject to any disclaimer, the term of this patent is extended or adjusted under 35 U.S.C. 154(b) by 0 days.

(21) Appl. No.: 10/238,239

(22) Filed: Sep. 10, 2002

(51) Int. Cl.[7] ..... A47C 23/00
(52) U.S. Cl. ..... 5/727; 5/722
(58) Field of Search ..... 5/727, 722, 737, 5/249, 250, 12.1

(56) References Cited

U.S. PATENT DOCUMENTS 814,654 A * 3/1906 Kee ..... 5/722
4,777,677 A * 10/1988 Dugan ..... 5/13
6,088,857 A 7/2000 Ogle

* cited by examiner

*Primary Examiner*—Teri Pham Luu
*Assistant Examiner*—Frederick Conley
(74) *Attorney, Agent, or Firm*—Harold L. Jackson

(57) ABSTRACT

A hingeable mattress and cover combination. The hingeable mattress having a base section with a footer, a pivotable section with a header, and straps connected at one end to the pivotable section such that an operator can pull on the straps and thereby rotate the pivotable section toward the operator. The cover has a pocket to receive the header of the pivotable section. When the operator has a grasp of the header, the cover is placed over the header, the pivotable section is lowered to a reclined position and the cover is extended over the side walls and footer of the hingeable mattress. The cover can be removed by taking the cover off the footer, rotating the pivotable section toward the operator, removing the cover from the header and reclining the pivotable section.

15 Claims, 4 Drawing Sheets

HINGED MATTRESS AND COVER COMBINATION

BACKGROUND OF THE INVENTION

1. Field of the Invention

This invention relates to a hinged mattress and cover used in combination to place a cover on, and remove the cover from, a mattress.

2. Description of the Prior Art

Hingeable mattresses have been used in a number of applications. These range from hospital mattresses that a patient can manipulate to customized mattresses for space conscience areas such as for a boat. In the case of a mattress on, for example, a boat, the mattress is usually designed to fit into an area that may be of an unusual shape and perhaps difficult to access. The hinge on such mattresses is designed to allow a section of the mattress, generally the end farthest away from a boat occupant, to be rotated upwardly to provide access to a storage compartment located within the bed frame.

It is often difficult for one to reach the front of the mattress to remove and replace a mattress pad and sheet without crawling on the top of the mattress because of the structure of the bulkhead. In such an environment, it would be useful to have a way to conveniently manipulate the mattress position and the mattress pad and/or sheet so that the person changing the mattress pad and/or sheet can do so in an efficient manner and with as little difficulty as possible, i.e. without the need to crawl on top of the mattress. The present invention provides a solution to this need.

SUMMARY OF THE INVENTION

The hinged mattress and cover combination has a hinged mattress with at least a base section hingably connected to a pivotable section, top and bottom surfaces, and front, rear and side walls extending between the top and bottom surfaces. The mattress defines a header as part of the pivotable section and a footer as part of the base section. The cover is adapted to overlay at least the top, header and footer, and preferably the side walls of the mattress. The cover can be in the form of a mattress pad, sheet or a combination sheet and pad.

One or more straps, each having a length and two ends, extends along the top surface of the mattress with a first end of the straps being attached to the pivotable section of the hinged mattress. Preferably the first end of the straps is connected, via a buckle, to the bottom of the front wall, i.e., adjacent the bottom surface, with the buckle allowing for an adjustment of the length of the straps. While the second (or other) end of the straps may be loose, it is preferably attached to the bottom of the rear wall of the mattress. When sufficient force is applied to an intermediate portion of the straps the pivotable section will pivot about the hinge from a substantially reclined position to a position where a person can grasp the header of the hinged mattress.

The cover has a pocket adapted to receive, or fit over, the header of the pivotable section when a person has a grasp of the header. After the pocket is placed over the header of the pivotable section the pivotable section is reclined and the cover is fitted over the mattress top surface, the side walls and the footer which includes the rear wall.

DETAILED DESCRIPTION OF THE DRAWINGS

Figure 1:
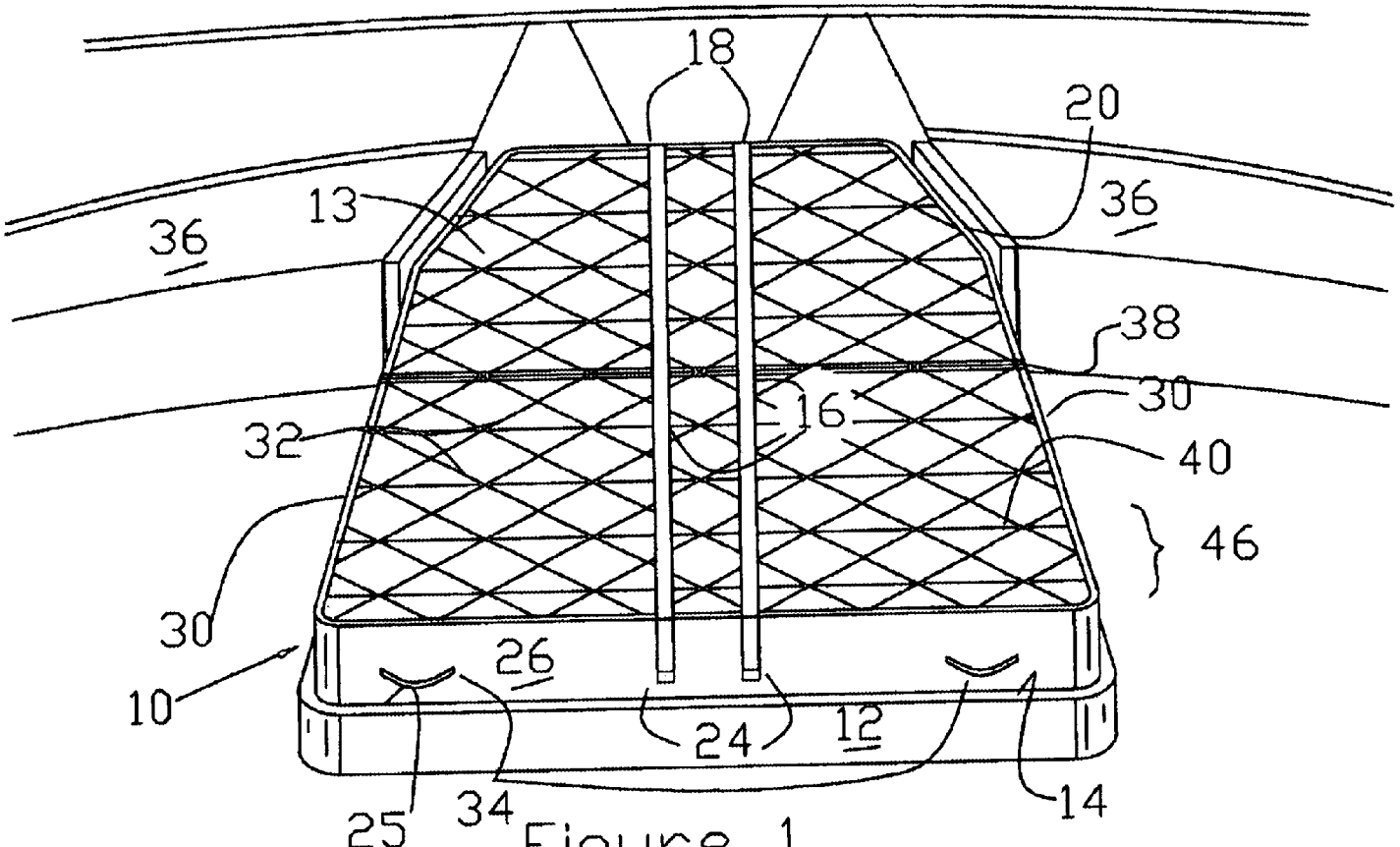
FIG. 1 is a perspective view of the hingeable mattress and straps of the present invention with the mattress being positioned in a bed frame mounted to a bulkhead section of a boat.

The present invention may best be understood by reference to the following description taken in conjunction with the accompanying drawings. Referring now to the FIG. 1 a hinged mattress 10 is set within a bed frame 12. A lip 14 of the frame restricts the horizontal movement of the mattress. A pair of straps 16 lie on the top surface 13 of the mattress and are connected at one end (first end) 18 to a pivotable section 20 at approximately the front end thereof and preferably on the front wall 22 (FIG. 5), adjacent the bottom surface 15 (FIG. 7*h*) of the mattress as will be explained. The second end of the straps 24 is attached adjacent of the bottom 25 of the rear wall 26 by suitable means such as sewing. The mattress includes sidewalls 30. The top surface may include conventional padding designated at 32. The rear wall 26 may be provided with handles 34 to enable a user to lift the rear end of the mattress above the lip of the frame when changing the mattress cover and/or sheets. The bed frame 12 is shown positioned between curved cabinet wall sections 36 adjacent the boat hull at the front of the mattress as is illustrated.

Figure 2:
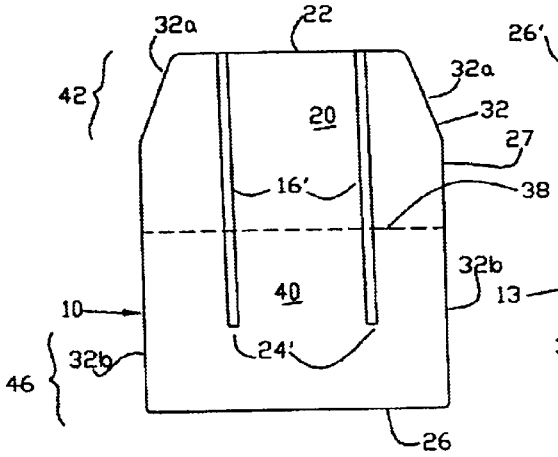
FIG. 2 is a top schematic view of the mattress of FIG. 1 showing the hinge line.

Referring now to FIG. 2, which is a schematic top view of the mattress with the exception that the lower end 24' of straps 16' are loose and not secured to the base section as is illustrated. The hinge line 38 of the mattress separates the pivotal section 20 from a base section 40. Such a hinge line is common in mattresses for boats so that the boat owner or user can lift up a section of the mattress and a hinged section of the bed frame which overlays a storage area under the bed. In the case shown in FIG. 1, the base section would probably overlie a storage area.

The pivotal section 20 defines a header 42 comprising the front wall 22, a portion of the top and bottom surfaces and a portion of the side walls 32 as is illustrated in FIG. 2. The side walls 32 include upper sections 32*a* which are oriented at an angle to the lower section 32*b* to fit into a bed frame such as that illustrated in FIG. 1. A footer 46 comprises the rear wall 26, a portion of the top and bottom surfaces and a portion of the side walls 32 as is shown on FIG. 2. As pointed out previously, the second end 24' of the straps 16' in the mattress of FIG. 2 remain loose and are not affixed to the mattress as is the case with the arrangement in FIG. 1.

Figure 3:
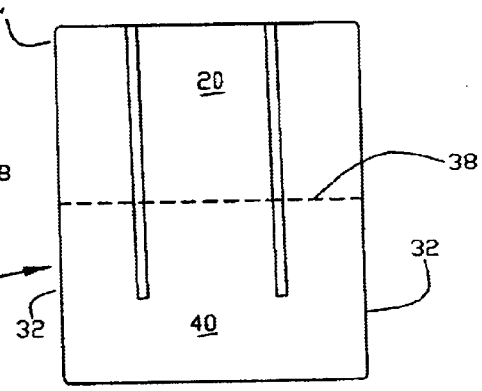
FIG. 3 is a top schematic view of a mattress where a portion of the side walls are not oriented parallel to each other.

FIG. 3 illustrates a hinged mattress similar to the one shown in FIG. 1 except that the mattress has a rectangular shape with parallel side walls.

Figure 4A:
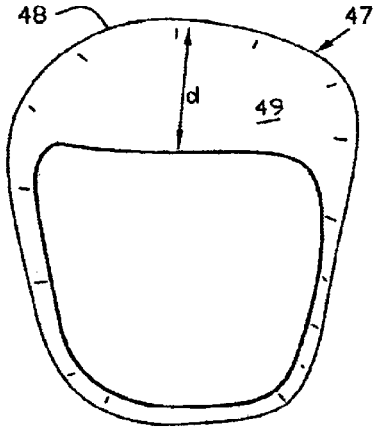
FIG. 4*a* is a bottom view of a cover for use with the mattress of FIG. 1 or 3 displaying the pocket that receives the header of the hingeable mattress.

Turning to FIG. 4*a*, a cover 47 is displayed which includes a pocket 48 at the front section thereof. The cover 47 is used in conjunction with the hinged mattress 10 to enable a user to readily place a mattress cover and/or a fitted sheet on the mattress or remove the same as will be explained subsequently. The pocket 48 is adapted to receive, or fit over the header 42. The pocket 48 has a depth d preferably with the range of about 8 to 20 inches and most preferably within the range of about 10 to 15 inches. The depth of the pocket may be dependent to some extent on the size of the mattress.

Figure 4B:
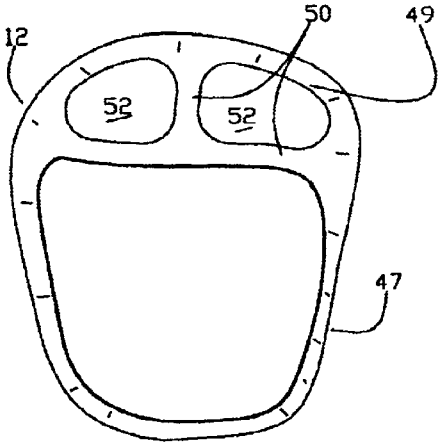
FIG. 4*b* is a bottom view of an alternative cover where the pocket bottom is formed by strip-like connector sections with openings therebetween.
Figure 4C:
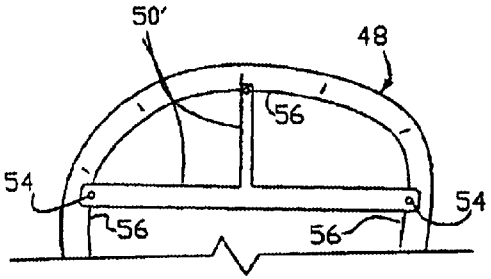
FIG. 4*c* is a bottom view of another cover where the pocket is delineated by a T-shaped strip arranged to be secured to the sides of the cover.

The lower surface 49 of the pocket may be made out of webbing, straps, etc. FIG. 4*b* identifies the use of strip connectors 50 leaving open spaces 52 along the bottom of the pocket. Any combination of strip connectors (or webbing) can be used to form the bottom 49 of the pocket. For example, FIG. 4*c* shows another arrangement of strip connectors 50' forming the bottom of the pocket 48.

Figure 4D:
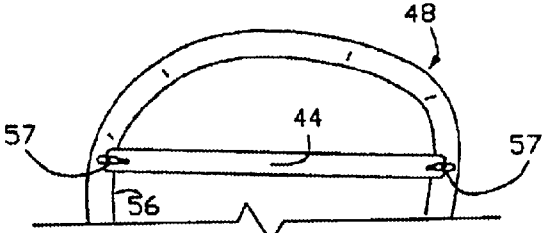
FIG. 4*d* is a bottom view of another cover arrangement where the pocket is delineated by a single connector strap.

The strip connectors can be attached to the cover/sheet 47 in a number of ways. While FIG. 4*a* and 4*b* show the strip connectors formed integrally with the pocket 48, FIG. 4*c* shows a button type assembly 54 connecting a T-shaped strip 50' to the bottom edge 56 of the cover. FIG. 4*d* displays a belt buckle type connection 57 that performs the same function. While these figures are illustrative of a number of ways the pocket can be formed in the bottom of the cover 46, these figures are not exhaustive of all possible equivalent ways to form the pocket.

Figure 6:
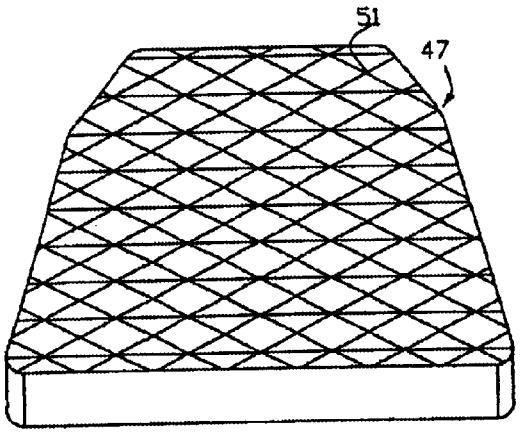
FIG. 6 is a perspective view of a cover in the form of a mattress pad illustrating the quilt-like padding which obscures the straps when in place over the mattress.
Figure 5:
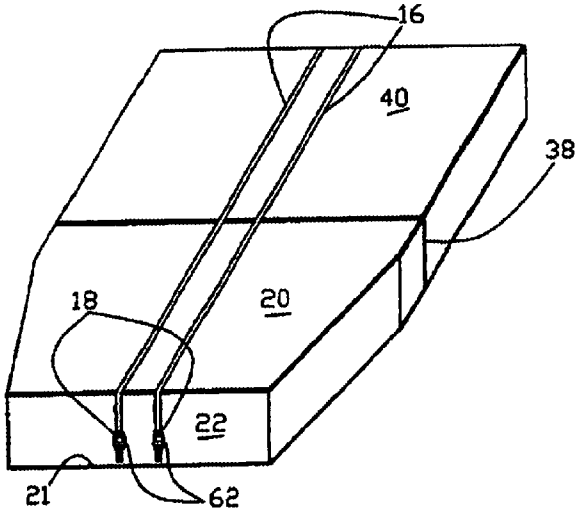
FIG. 5 is a perspective schematic view of the hingeable mattress of FIG. 1 showing the first end of the straps attached via a buckle, to the bottom of the front wall of the mattress.

FIG. 5 illustrates a perspective diagrammatic view of the mattress of FIGS. 1 and 2 and in particular shows a pair of conventional buckles 62 for securing the first end 18 of the straps 16 to the front wall of the mattress. The buckles permit a user to adjust the length of the straps, preferably to cause the straps to lie firmly against the top surface of the mattress as is illustrated. The buckles also allow the first end of the straps to be released from the front wall and the length of the straps to be adjusted. FIG. 6 is a top perspective view of the cover 47 including padding 51 on the top surface. The padding 51 provides a cushion between the person sleeping and the straps 16. Thus, a person lying on the mattress pad would not discern, or not easily discern, the presence of the straps 16.

Figure 7A:
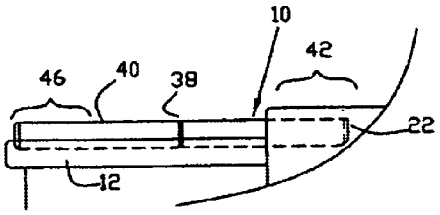
FIG. 7*a* is a schematic side view of the hingeable mattress in a reclined position on a bed frame.
Figure 7B:
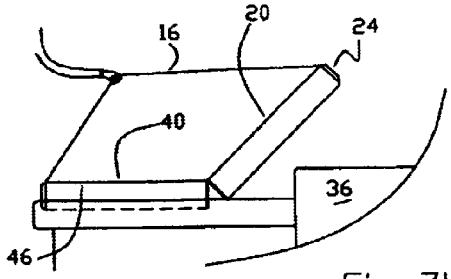
FIG. 7*b* is a schematic side view of the hingeable mattress with force being applied to an intermediate portion of the straps and the pivotable section rotating counterclockwise and moving rotationally upwardly.
Figure 7C:
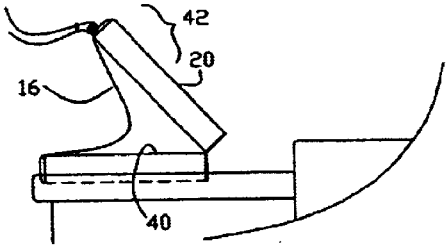
FIG. 7*c* is a schematic side view of the hingeable mattress when the force applied to the straps is sufficient to pivot the pivotable section of the mattress so a person can grasp the header.

Turning now to FIGS. 7*a* through 7*f*, the process for using the hinged mattress 10 and cover 47 is disclosed. In FIG. 5*a*, the hinged mattress 10 is setting within the bed frame 12 with the straps 16 (not shown) laying on the top surface of the mattress. FIG. 7*b* shows a person's hand grasping, or holding, an intermediate section of the straps 16 and pulling on that section to rotate the pivotal section 20 upwardly and rearwardly (counterclockwise in FIG. 7*b*) toward the footer 46. Force thus applied to the straps 16 causes the pivotable section 20 to rotate with the header 42 moving toward the person. FIG. 7*c* shows the person grasping the header 42 when the pivotable section 20 is in a convenient position. The exact location of the header 42, when grasped or held by the person in reference to the bed frame 12, will vary according to the desires of the person installing or removing the cover.

Figure 7D:
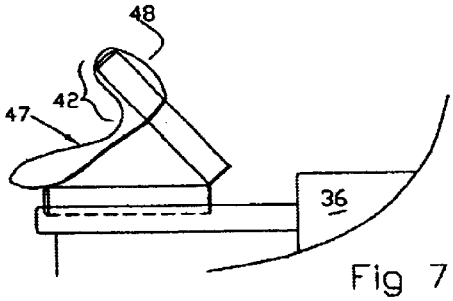
FIG. 7*d* is a schematic side view of the hingeable mattress where the pocket of the cover is placed over the header.
Figure 7E:
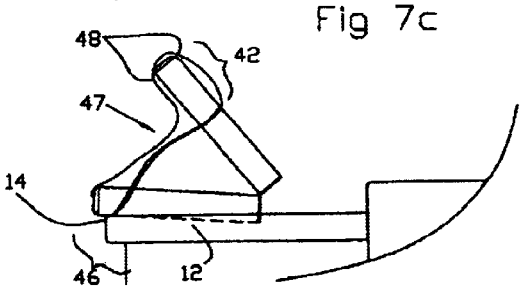
FIG. 7*e* is a schematic side view of the hingeable mattress where the pocket of the cover is placed over the header and the footer with the footer raised above the edge of the bed frame.
Figure 7F:
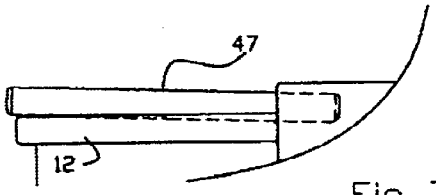
FIG. 7*f* is a schematic side view of the hingeable mattress in a reclined position with the footer raised above the bed frame.
Figure 7G:
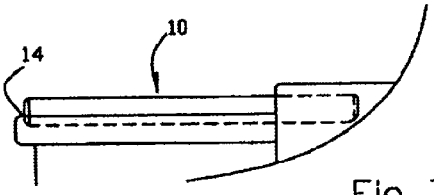
FIG. 7*g* is a schematic side view of the hingeable mattress with the cover in a reclined position.

The pocket 48 of the cover 47 in FIG. 7*d* is placed over the header 42. In FIG. 7*e* the footer 46 is raised above the lip 14 to allow the operator to conveniently place the lower end of the cover 47 over the footer 46. Once the cover is attached to the header 42 (and the footer 46, if desired), the pivotable section 20 is reclined and is supported by the bed frame 12 as is shown in FIG. 7*f*. In FIG. 7*g*, the mattress 10 with cover 47 thereon is slid back into position on the bed frame 12 where the lip 14 now restrains the movement of the hinged mattress 10. It should be noted that the cover 47 may be placed over the footer 46 after the pocket 48 has been placed over the header 42 and the pivotable section 20 allowed to recline.

Figure 7H:
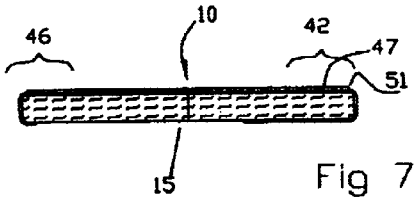
FIG. 7*h* is a cross-sectional side view of the hingeable mattress and cover, without the bed frame, identifying the cover fitted over the header and footer.

FIG. 7*h* is a cutaway view of the hinged mattress 10 with the cover 47 in place. The cover goes around the footer 46, header 42, top surface 13, front and rear walls 22, 26, a portion of the bottom surface 15 and opposing side walls 32 of the hinged mattress 10. Note, in this figure, the cover 47 includes as a top layer the quilted pad 49. This pad assists in masking the existence of the straps 12.

While the cover 47 normally fits over the opposing sides 32, it need not be so configured. The cover 47 could be secured in place by utilizing the header 42 and footer 46. Further, the cover 47, when in the form of a mattress pad or combined pad and fitted bottom sheet preferably includes a padded surface 51 so that when the cover 47 is in place the straps 12 virtually disappear.

There has thus been described a novel hinged mattress and cover combination. It is important to note that many configurations can be constructed from the ideas presented. Thus, nothing in the specification should be construed to limit the scope of the claims.

What is claimed is:

1. In a hinged mattress and cover combination, the hinged mattress having at least a base section connected to a pivotable section, top and bottom surfaces, a header as part of the pivotable section, a footer as part of the base section, and opposing side walls, the cover being adapted to fit over at least the top surface and a portion of the bottom surface adjacent to the header, and the footer of the mattress the combination comprising:

a) at least one strap having first and second ends and extending along at least a portion of the top surface of the pivotal section and base sections of the mattress with the first end of the strap being attached to the pivotable section of the hinged mattress such that force applied to the strap extending along the surface of the base section causes the pivotable section to pivot about the hinge sufficiently to allow a person to grasp the header of the hinged mattress; and b) the cover having a pocket adapted to receive the header of the pivotable section when a person has a grasp of the header of the pivotable section whereby after the pocket receives the pivotable section and the pivotable section is in the reclined position the cover is adapted to fit over the top surface of the mattress, and the footer.

2. The hinged mattress and cover combination of claim 1 further comprising a pad attached to the surface of the cover which is arranged to fit over the top surface of the mattress.

3. The hinged mattress and cover combination of claim 1 wherein the mattress defines a front and a rear wall and wherein the first end of the strap is connected to the front wall.

4. The hinged mattress and cover combination of claim 3 wherein the second end of the strap is connected to the rear wall.

5. The hinged mattress and cover combination of claim 4 further including a buckle connecting the first end of the strap to the front wall.

6. The hinged mattress and cover combination of claim 5 wherein the at least one strap comprises two straps.

7. The hinged mattress and cover combination of claim 4 wherein the depth of the pocket is within the range of about 10 to 15 inches.

8. The hinged mattress and cover combination of claim 1 wherein the pocket of the cover has a depth d within the range of about 6 to 20 inches.

9. The hinged mattress and combination of claim 1 wherein the cover is a mattress pad.

10. The hinged mattress and cover combination of claim 1 wherein the cover is a fitted bottom sheet.

11. The hinged mattress and cover combination of claim 1 wherein the cover is a combined mattress pad and fitted bottom sheet.

12. A method of placing a cover on a hinged mattress, the hinged mattress having at least a base section hingably connected to a pivotable section, top and bottom surfaces, a header as part of the pivotable section, a footer as part of the base section, and opposing side walls, the cover being adapted to fit over the mattress surface, side walls and footer and having a pocket adapted to receive the header of the pivotable section, and one or more straps connected at one end to the pivotable section and extending over the top surface of the pivotal section and along at least a portion of the top surface of the base section of the mattress, the steps comprising:

pulling on the portion of the straps extending along the base section to rotate the pivotable section sufficiently to allow a person to grasp the header of the pivotable section;

placing the pocket of the cover over the header of the pivotable section;

lowering the pivotable section to a substantially reclined position; and placing the cover over the top, opposing side walls, and footer of the hinged mattress.

13. A method of removing a cover from a hinged mattress, the hinged mattress having at least a base section hingably connected to a pivotable section, top and bottom surfaces, a header as part of the pivotable section, a footer as part of the base section, and opposing side walls, the cover being adapted to fit over the mattress surface, side walls and footer and having a pocket adapted to receive the header of the pivotable section, and one or more straps connected to the pivotable section and extending substantially along the surface of the hinged and base sections of the mattress the steps comprising:

removing the cover from the footer and a portion of the top surface of the base section to expose the strap lying on the base section;

pulling the strap to rotate the pivotable section sufficiently to allow a person to hold the header of the pivotable section;

removing the cover from the header and opposing sides of the hinged mattress; and lowering the pivotable section to a substantially reclined position.

14. A method of placing a cover on a hinged mattress, the hinged mattress having at least a base section hingably connected to a pivotable section, top and bottom surfaces, a header as part of the pivotable section, a footer as part of the base section, and opposing side walls, the cover being adapted to fit over the mattress top surface, side walls and footer and having a pocket adapted to receive the header of the pivotable section, and a pair of straps connected at one end to the pivotable section and at the other end to the base section and extending substantially along the top surface of both the pivotal and base sections of the hinged mattress, the steps comprising:

pulling on an intermediate section of the straps to rotate the pivotable section sufficiently to allow a person to hold the header of the pivotable section;

placing the pocket of the cover over the header of the pivotable section and covering the footer;

lowering the pivotable section to a substantially reclined position; and placing the cover over the top and opposing sides of the hingeable mattress.

15. A mattress and strap assembly comprising:

a hinged mattress having a base section hinged to a pivotal section with a top surface, the base and pivotal sections defining a footer and header, respectively, remote from the hinge; and a pair of straps extending along the entire top surface of the mattress and connected at one end to the header and at the other end to the footer, whereby one can pull the straps extending along the top surface of the base section and rotate the pivotal section upwardly with respect to the base section.

* * * * *